US006072155A

United States Patent [19]

Tomatsu

[11] Patent Number: 6,072,155

[45] Date of Patent: Jun. 6, 2000

[54] FIXATION DEVICE

[75] Inventor: Yoshiya Tomatsu, Kasugai, Japan

[73] Assignee: Brother Kogyo Kabushiki Kaisha, Nagoya, Japan

[21] Appl. No.: 09/234,503

[22] Filed: Jan. 21, 1999

[30] Foreign Application Priority Data

Jan. 22, 1998 [JP] Japan ..... 10-010786
Mar. 31, 1998 [JP] Japan ..... 10-086451

[51] Int. Cl.[7] ..... G03G 15/20

[52] U.S. Cl. ..... 219/216; 399/333

[58] Field of Search ..... 219/216, 469; 399/330, 331, 333

[56] References Cited

U.S. PATENT DOCUMENTS 5,575,942 11/1996 Watanabe .
5,729,814 3/1998 Suzuki et al. ..... 399/333
5,826,152 10/1998 Suzuki et al. ..... 399/330

FOREIGN PATENT DOCUMENTS 8-194401 7/1996 Japan .
8-220915 8/1996 Japan .

OTHER PUBLICATIONS

CAN/CSA C22.2 No. 950–95), UL1950, 1995–1998.

*Primary Examiner*—Joseph Pelham
*Attorney, Agent, or Firm*—Oliff & Berridge, PLC

[57] ABSTRACT

A fixing apparatus comprises a fixing heating roller for heating a recording medium deposited with a recording material, and a pressing roller for transporting the recording medium while interposing it between the fixing heating roller and the pressing roller. The heating roller includes a hollow main roller body, and a sheet-shaped insulative film provided over an inner circumferential surface of the main roller body. A pattern of a resistance heat-generating element and an electrode pattern connected to the pattern of the resistance heat-generating element are formed on the insulative film. A margin is provided between the electrode pattern and at least one of edges of the insulative film in the circumferential direction, and the margin has a size which is not less than a distance that conforms to the UL1950 standard with respect to a voltage supplied to the resistance heat-generating element. Thus, the insulation performance between the electrode pattern and the main roller body is ensured.

19 Claims, 10 Drawing Sheets

FIXATION DEVICE

BACKGROUND OF THE INVENTION

1. Field of the Invention

The present invention relates to a fixation device (fixing apparatus) to be used, for example, with an image-forming apparatus for forming an image by depositing a recording material onto a recording medium such as a paper sheet, in order to fix the recording material deposited on the recording medium.

2. Description of the Related Art

An image-forming apparatus has been hitherto known, which is provided with an image-forming means for forming an image by depositing a recording material such as toner and ink onto a recording medium such as a paper sheet and a film. Such an image-forming apparatus is provided with a fixing apparatus for fixing the recording material deposited on the recording medium by means of the image-forming means in many cases. A typical fixing apparatus comprises a fixing heating roller for heating the recording material deposited on the recording medium, and a pressing roller for pressing the recording medium against the outer circumferential surface of the fixing heating roller. The fixing apparatus constructed as described above can be operated such that the recording medium after the formation of the image is transported while being interposed by the fixing heating roller and the pressing roller to heat and pressurize the recording material together with the recording medium so that the recording material is fixed on the recording medium.

An example of the structure of the fixing heating roller is described in the section of the related art in U.S. Pat. No. 5,575,942. That is, a structure is known, in which a halogen lamp is contained at the inside, and the heat generated by the halogen lamp is conducted to the roller surface. Thus, the temperature of the entire fixing heating roller is raised. However, the halogen lamp of such a fixing heating roller is usually arranged in the vicinity of an axis of rotation of the roller. Therefore, the thermal efficiency is inferior, and a long period of time has been required to raise the temperature of the surface of the fixing heating roller to a temperature suitable for the fixing operation, from the start of electric power application to the halogen lamp.

A variety of improvements have been applied to such a fixing heating roller in order to enhance the thermal efficiency and improve the temperature-raising speed. For example, in the case of the fixing heating roller disclosed in U.S. Pat. No. 5,575,942, a resistance heat-generating member is glued and fixed on the inner circumferential surface of a main roller body which is formed to have a cylindrical configuration. The resistance heat-generating member is a heat-generating element sheet having flexibility comprising a resistance heat-generating element which is stuck to the surface of an insulative film material composed of a polyimide resin film, the resistance heat-generating element comprising a predetermined pattern of a resistance member composed of one foil film or a plurality of foil films made of stainless steel or copper. The insulative film material is formed with a conductive power supply section for applying the electric power to the resistance member. The electric power is supplied from the power supply section to the pattern of the resistance member to generate the heat. Thus, the main roller body is efficiently heated from its inner circumferential surface.

In the case of the fixing heating roller disclosed in U.S. Pat. No. 5,575,942, it is desired that a voltage such as a primary voltage, which is as high as possible, is applied to the pattern in order to further improve the temperature-raising speed. However, since the insulative film material is the flexible foil film sheet, a problem arises concerning the spatial insulation performance between the pattern of the resistance member and the main roller body. If the insulation performance is insufficient, the current flows through the main roller body, for example, via the end edge of the insulative film material, when a high voltage is applied to the pattern, which raises a possibility to cause, for example, the electric leak, the short circuit, and the dielectric breakdown. As a result, there is a possibility to cause any electric shock of a user, any generation of electric noise, and any deformation or damage of parts.

Japanese Patent Application Laid-Open No. 8-220915 discloses a fixing heating roller having a structure similar to that of the fixing heating roller disclosed in the United States Patent described above. An insulative film material, which is accommodated at the inside of a heating roller disclosed in this patent document, is arranged such that both ends in the circumferential direction are doubly overlapped in order to ensure the insulation performance between a pattern of a resistance member and a main roller body. For this reason, the thermal efficiency and the temperature-raising speed are not improved so much at the portion at which the insulative film material is doubly overlapped, as compared with other portions. Therefore, there is a possibility to cause unevenness in temperature on the outer circumferential surface of the fixing heating roller.

A first object of the present invention is to provide a fixing apparatus and an image-forming apparatus containing the same, the fixing apparatus comprising a fixing heating roller provided with a pattern of a resistance heat-generating element on a circumferential wall of a main roller body, making it possible to sufficiently ensure the insulated state of the pattern and the main roller body by means of a simple structure.

A second object of the present invention is to provide a fixing apparatus and an image-forming apparatus containing the same, the fixing apparatus comprising a pattern of a resistance heat-generating element on a circumferential wall of a main roller body, making it possible to suppress occurrence of unevenness in temperature on the outer circumference of the roller.

SUMMARY OF THE INVENTION

According to a first aspect of the present invention, there is provided a fixing apparatus comprising a fixing heating roller for heating a recording medium on which a recording material is deposited, and a pressing roller for transporting the recording medium while interposing it between the fixing heating roller and the pressing roller, the fixing heating roller including:

a hollow main roller body; and a sheet-shaped insulative film provided on and along an inner circumferential surface of the main roller body, the sheet-shaped insulative film having a pattern of a resistance heat-generating element formed on the insulative film and an electrode pattern connected to the pattern of the resistance heat-generating element, wherein:

a margin is provided between the electrode pattern and at least one of edges of the insulative film, and the margin has a size which is not less than a distance that conforms to the UL1950 standard concerning a voltage supplied to the resistance heat-generating element. According to the UL1950 standard (CAN/

CSA C22.2 No. 950-95, UL1950), as described in Table 6 (UL1950, page 77), for example, it is defined for the material group I having the Pollution degree 2 that the minimum creepage distance necessary for the operational insulation, the basic insulation, and the supplementary insulation is 0.7 mm, 0.8 mm, 1.0 mm, and 1.3 mm with respect to the operation voltage of 100 V, 125 and 150 V, 200 V, and 250 V respectively. The creepage distance for the reinforced insulation is twice the distances described above. Therefore, for example, when a voltage of 125 V is supplied to the resistance heat-generating element, if the reinforced insulation is required, it is necessary to provide a margin of not less than 1.6 mm. The minimum spatial distance is also defined in Table 3 of the UL1950 standard (UL1950, page 74) with respect to the primary circuit and the insulation between the primary circuit and the secondary circuit. The content of the UL1950 standard is incorporated herein by reference.

In the fixing apparatus according to the present invention, the predetermined margin is provided between the electrode pattern (power supply section) and at least one edge of the insulative film. Accordingly, it is possible to appropriately ensure the insulated state between the electrode pattern and the main roller body. Therefore, the electric leak, the short circuit, and the dielectric breakdown can be previously avoided, and it is possible to fix the image safely and stably. The margin may be provided at least at one edge in the circumferential direction (the edge of the insulative film accommodated in the hollow section of the main roller body in the circumferential direction of the main roller body, see the distance T shown in FIG. 5). The margin for the electrode pattern is not limited to the provision at the edge of the insulative film in the circumferential direction. It is also preferable to provide the margin having a distance which is not less than the distance that conforms to the UL1950 standard concerning the voltage supplied to the resistance heat-generating element between the electrode pattern and the edge of the insulative film in a direction perpendicular to the circumferential direction (see the distance S shown in FIG. 5).

The heating roller can be produced by arranging the insulative film sheet formed with the pattern of the resistance heat-generating element along the inner circumferential surface of the main roller body. Therefore, the fixing apparatus can be easily produced, and it is possible to reduce the production cost. Especially, when the insulative film is one sheet of rectangular sheet-shaped film, the heating section can be installed to the roller only by rounding the insulative film and inserting it into the hollow section of the main roller body. Further, since the insulative film is accommodated at the inside of the main roller body, neither abrasion nor breakage of the electrode and the heating element is caused, making it possible to obtain extremely excellent durability.

In order to uniformly cover the inner circumferential surface of the main roller body with the pattern of the heat-generating element, the insulative film may be arranged on the inner circumferential surface of the main roller body so that the edges of the insulative film in the circumferential direction are overlapped with each other. In this embodiment, the margin to the electrode pattern from the outer edged disposed on the side of the center of the main roller body, of the overlapped edges of the insulative film (see 17*c* shown in FIG. 4B) is not less than the distance which conforms to the UL1950 standard with respect to the voltage supplied to the resistance heat-generating element. Concerning the outer edge disposed on the side of the main roller body, of the overlapped edges of the insulative film (see 17*c* shown in FIG. 4B), unless the creepage distance (distance in the direction along the surface of the insulative film) between the end of the electrode pattern and the main roller body is not less than 1.6 mm (reinforced insulation), for example, when a voltage of 125 V is applied as the voltage to be supplied to the resistance heat-generating element, then there is a fear of occurrence of any dielectric breakdown therebetween. On the other hand, concerning the inner edge disposed on the side of the main roller body, of the overlapped edges of the insulative film (see 17*d* shown in FIG. 4B), the dielectric breakdown scarcely occurs because of the predetermined spatial distance (distance T shown in FIG. 4B) from the main roller body owing to the presence of the outer edge of the insulative film.

When the insulative film is arranged on the inner circumferential surface of the main roller body so that the edges of the insulative film in the circumferential direction are overlapped with each other, it is desirable that the margin from the outer edge to the pattern of the resistance heat-generating element is also not less than the distance which conforms to the UL1950 standard with respect to the voltage supplied to the resistance heat-generating element. When the margin between the pattern of the resistance heat-generating element and the outer edge of the insulative film is also adjusted as described above, it is possible to avoid any electric leak via the insulative film between the pattern of the resistance heat-generating element and the main roller body.

In the fixing apparatus according to the present invention, the margin from the edge of the insulative film to the electrode pattern or the pattern of the resistance heat-generating element may be not less than about 2.6 mm. By doing so, even when a voltage of 240 V is applied to the pattern, then it is possible to ensure the insulated state between the main roller body and the pattern, and it is possible to satisfy the UL standard as well. That is, when the margin is not less than about 2.6 mm, then the electric leak, the short circuit, and the dielectric breakdown can be avoided beforehand, and it is possible to fix the image more safely and stably, even when the primary voltage is applied to the pattern while using the fixing apparatus in every country in the world.

The fixing apparatus according to the present invention may further comprise a power supply member fixed to the main roller body to make contact with the electrode pattern for supplying electric power to the electrode pattern. In this embodiment, the distance from the power supply member to the edge of the insulative film is not less than the distance which conforms to the UL1950 standard with respect to the voltage supplied to the resistance heat-generating element. When the electric power is supplied to the power supply section by the aid of the power supply member fixed to the main roller body, then it is possible to improve the degree of freedom of the design concerning, for example, the shape of the electrode disposed on the side of the main image-forming apparatus, and it is possible to stably supply the electric power. Since the distance from the power supply member to the edge of the insulative film is set to be the value as described above, it is possible to previously avoid the electric leak, the short circuit, and the dielectric breakdown between the power supply member and the pattern, and it is possible to fix the image safely and stably.

The electrode pattern may be a band-shaped pattern extending in the circumferential direction on the insulative film. The band-shaped pattern makes it easy to contact with, for example, a ring-shaped power supply member and an electrode disposed on the side of a voltage-applying unit.

In the fixing apparatus according to the present invention, the pattern of the resistance heat-generating element may be formed in an overlapped area at the inner edge disposed on the side of the center of rotation of the main roller body, of the overlapped edges of the insulative film. The pattern of the resistance heat-generating element, which is formed in the overlapped area, may have an amount of heat generation that is larger than that of the pattern of the resistance heat-generating element formed on the other portions. Accordingly, the heat of the amount of heat generation larger than that of the other areas is conducted in the portion at which the insulative film material is overlapped. In the area of the overlapped insulative film, the heat transfer efficiency is lowered because the thickness of the insulative film is twice as compared with the other areas. However, it is possible to appropriately suppress the occurrence of unevenness in temperature on the outer circumferential surface of the fixing heating roller by adjusting the amount of heat generation as described above. Thus, the recording material, which is deposited on the recording medium, can be fixed extremely appropriately and uniformly.

In order to adjust the amount of heat generation as described above, the cross-sectional area of the pattern of the resistance heat-generating element formed on the overlapped area at the inner edge may be smaller than the cross-sectional area of the pattern of the resistance heat-generating element formed on the other portions. Accordingly, the resistance value of the pattern in the overlapped area is larger than that of the other areas. As a result, the amount of heat generation is increased in this area as well. The way or form to decrease the cross-sectional area of the pattern in the foregoing area as compared with the pattern in the other areas includes, for example, the way to narrow the width of the pattern, the way to thin the thickness of the pattern, and the way to combine the both ways. When the width of the pattern is narrowed while maintaining the thickness of the pattern to be constant, such a pattern can be easily produced by using a well-known etching process. The thickness of the entire insulative film is generally increased in the area in which the insulative film is doubly overlapped. However, the thickness of the insulative film including the pattern can be made relatively uniform in the circumferential direction by thinning the thickness of the pattern provided in the area described above. The fixing heating roller may be constructed such that an elastic material is charged at the inside of the pattern and the insulative film, and the pattern and the insulative film are pressed to make contact with the inner circumferential surface of the main roller body so that the thermal efficiency is further increased. However, when the thickness is made uniform as described above, then the pressurized contact force applied by the elastic member is made uniform, and it is possible to suppress the occurrence of unevenness in temperature more appropriately. Therefore, when the thickness of the pattern is made thin to decrease the cross-sectional area thereof, the recording material deposited on the recording medium can be fixed more appropriately and uniformly.

The length per unit area of the insulative film, of the pattern of the resistance heat-generating element formed in the overlapped area at the inner edge may be made smaller than the length per unit area of the insulative film, of the pattern of the resistance heat-generating element formed on the other portions. By doing so, the amount of heat generation in the overlapped area is larger than that of the other areas. Such a pattern can be easily produced by means of a well-known etching process.

In the fixing apparatus according to the present invention, it is preferable that the pattern of the resistance heat-generating element is not formed in the overlapped area at the outer edge disposed on the inner circumferential side of the main roller body, of the edge at which the insulative film is overlapped. By doing so, it is possible to obtain the insulation performance between the pattern and the main roller body more reliably.

According to a second aspect of the present invention, there is provided an image-recording apparatus which is provided with the fixing apparatus according to the present invention.

DESCRIPTION OF THE PREFERRED EMBODIMENTS

Figure 1:
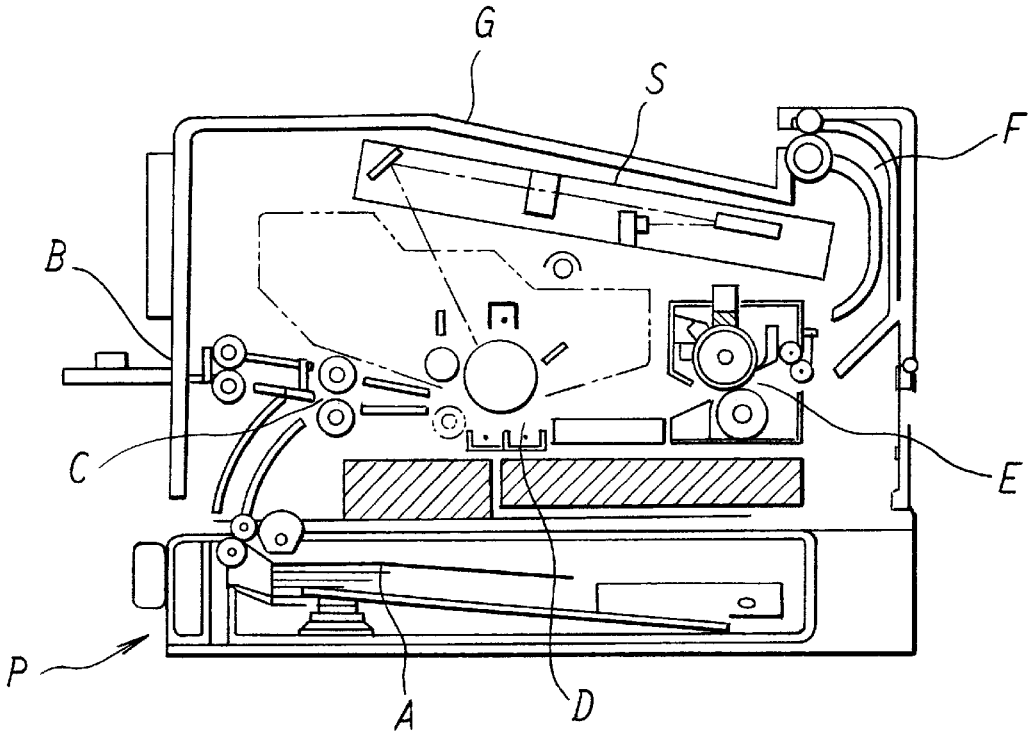
FIG. 1 shows a sectional view illustrating a structure of a printer to which the present invention is applied.

Embodiments of the present invention will be explained with reference to the drawings. FIG. 1 shows a sectional view illustrating a structure of a printer P (corresponding to the image-forming apparatus) based on the electrophotographic system constructed by using a fixing apparatus according to the present invention. The printer P is a laser printer to carry out exposure based on the use of a laser. At first, the structure of the printer P will be briefly explained on the basis of FIG. 1.

The printer P comprises a paper feed cassette section A for stacking and accommodating paper sheets as recording media, a manual paper feed section B capable of feeding the paper sheets one by one, a paper sheet transport section C for transporting the paper sheet fed from the paper feed cassette section A or the manual paper feed section B, an electrophotographic processing section D (corresponding to the image-forming means) provided with, for example, a drum-type electrophotographic photosensitive member, a charging unit, a developing unit, and an electricity-removing unit, for depositing the toner as a recording material onto the transported paper sheet to form an image, a laser beam scanner S (exposing unit) for exposing the charged photosensitive member with a scanning laser beam modulated in accordance with the image data to form an electrostatic latent image on the photosensitive member, a thermal fixing section E provided with, for example, a fixing heating roller and a pressing roller, for fixing the toner deposited on the paper sheet by means of the heat, and a paper sheet discharge section F for transporting the paper sheet fixed with the toner to a receiving tray disposed at an upper portion of the main apparatus body. The components A to F are accommodated in a main housing body G.

Figure 2:
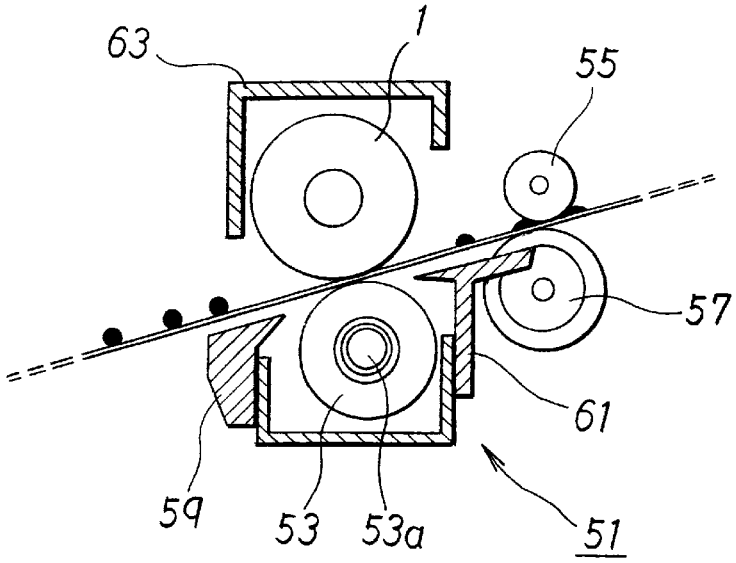
FIG. 2 shows a sectional view illustrating a structure of a fixing apparatus of the printer shown in FIG. 1.

FIG. 2 shows a sectional view illustrating the structure of a fixing apparatus 51 arranged in the thermal fixing section E. The fixing unit 51 comprises, for example, a fixing heating roller (hereinafter simply referred to as "heating roller") 1 for heating the toner deposited on the paper sheet, a pressing roller 53 including, for example, heat-resistant silicon rubber arranged around a metal shaft 53*a*, for pressing the paper sheet against the outer circumferential surface of the heating roller 1, discharge rollers 55, 57 for discharging the paper sheet to the outside of the apparatus, paper sheet guides 59, 61 for guiding the paper sheet to the predetermined position, and a cover 63 for covering the heating roller 1 and the pressing roller 53 therewith. The heating roller 1, which has the characteristic feature of the present invention, provides the heat for fixing the toner onto the paper sheet in the fixing unit 51, and it also plays a role to transport the paper sheet toward the discharge rollers 55, 57 while interposing the paper sheet between the heating roller 1 and the pressing roller 53.

Figure 3:
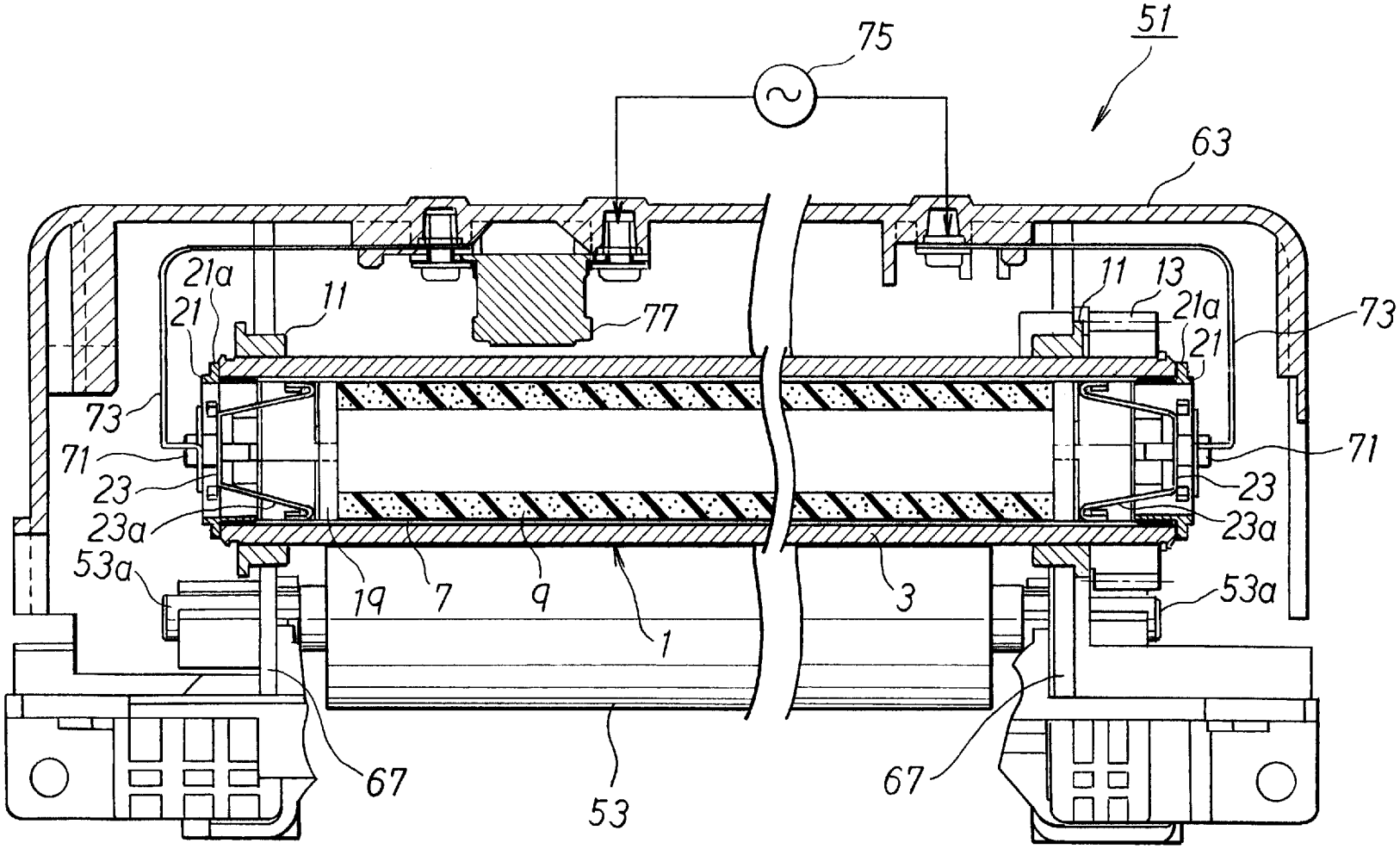
FIG. 3 shows a sectional view taken along an axis of rotation of a heating roller of the fixing apparatus shown in FIG. 2.
Figure 4A:
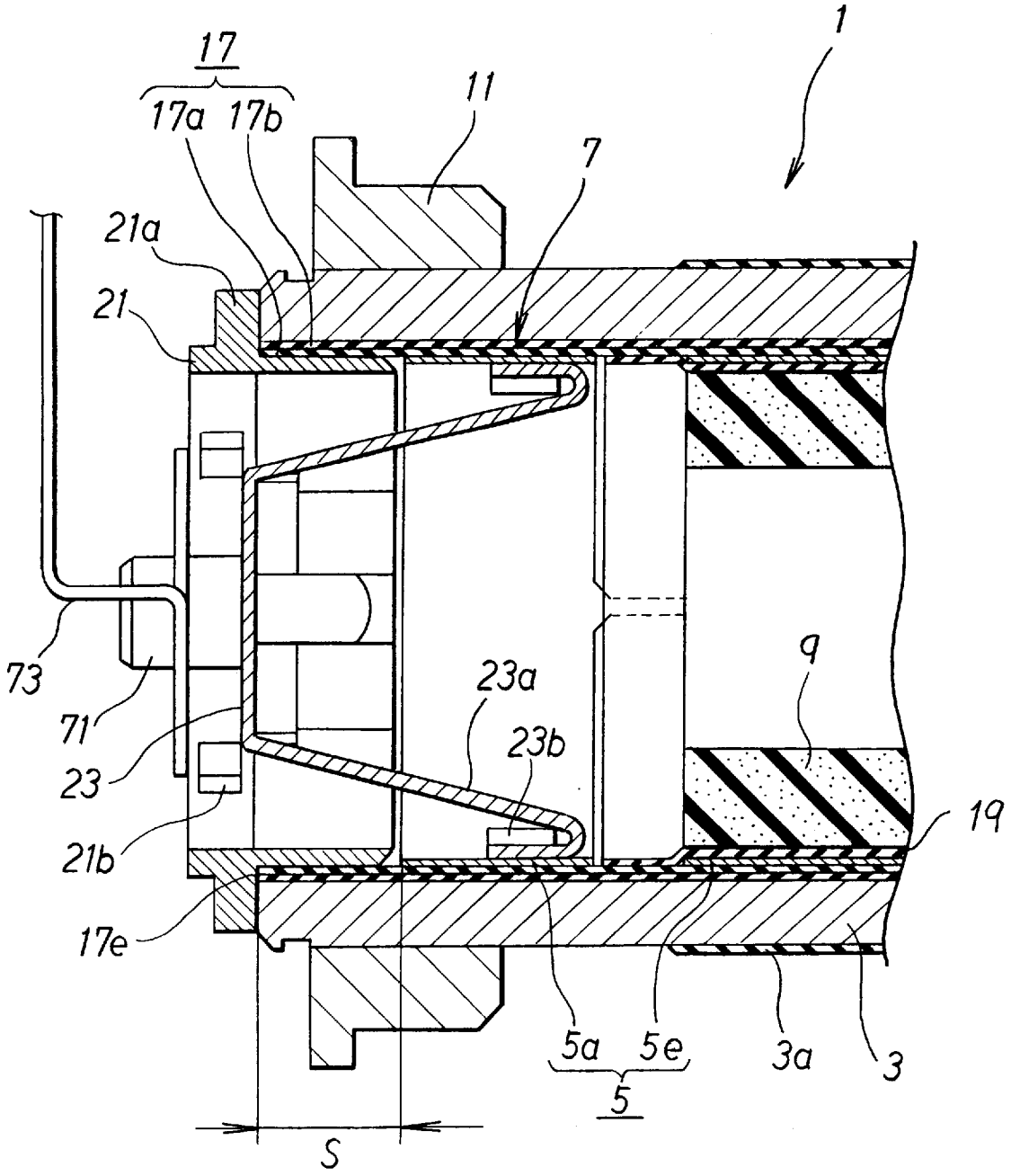
FIG. 4A shows a magnified sectional view illustrating a structure in the vicinity of an end of the heating roller.

Next, the heating roller 1 will be explained in detail below. FIG. 3 shows a sectional view illustrating the structure of the fixing apparatus 51, taken along the axis of rotation of the heating roller 1. FIG. 4A shows a magnified sectional view illustrating the structure in the vicinity of the left end of the heating roller 1 shown in FIG. 3. The heating roller 1 comprises a main roller body 3 having a hollow cylindrical configuration made of aluminum. A heat-generating element sheet 7 provided with a resistance heat-generating element pattern 5 for generating the heat in accordance with the electric power application, and a sponge tube 9 composed of a silicon sponge as an elastic material are successively arranged on the inner circumferential surface of the main roller body 3. A pair of bearings 11 are fitted and fixed in the vicinity of both ends on the outer circumferential surface of the main roller body 3. A spur gear 13 is fitted and fixed at the outside of one of the bearings 11 (disposed on the right side in FIG. 3).

In this embodiment, the pair of bearings 11 are designed to be conductive as comprising carbon dispersed in PPS (polyphenylene sulfide) which is excellent in heat resistance. The pair of bearings 11 are rotatably supported by a heat-resistant resin frame 67 together with a metal shaft 53*a* of the pressing roller 53. The main roller body 3 is grounded via the bearings 11. The pressing roller 53 is grounded via the metal shaft 53*a*. Accordingly, the heating roller 1 or the pressing roller 53 is prevented from deposition of the charged toner or the like. Further, it is possible to avoid, for example, generation of noise. A rotary force is transmitted to the spur gear 13 from an unillustrated driving system. Accordingly, the main roller body 3 can be rotated to transport the paper sheet. Further, a coating 3*a* (see FIG. 4A), which is composed of a fluororesin excellent in heat resistance and release performance, is applied to a portion of the outer circumferential surface of the main roller body 3 for making contact with the pressing roller 53 under the pressure.

Figure 4B:
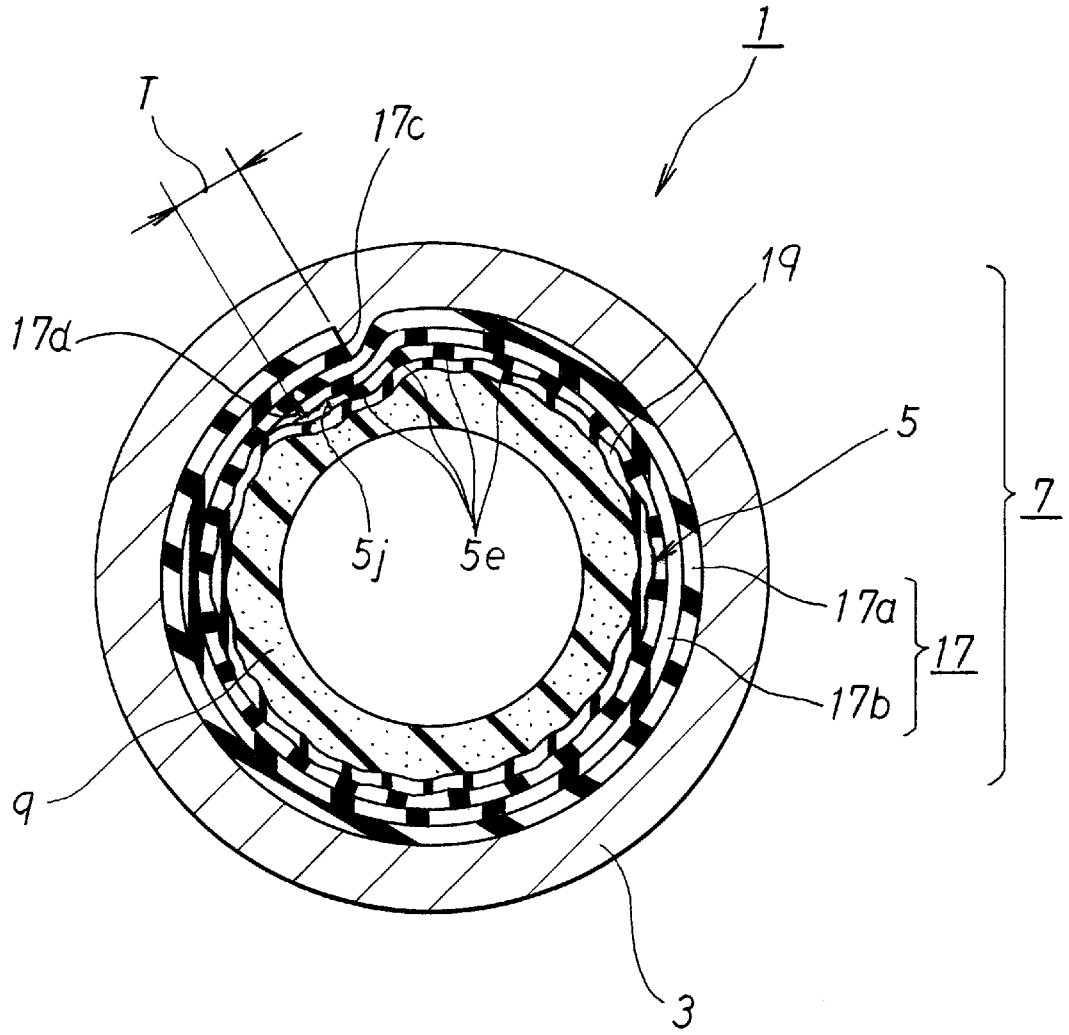
FIG. 4B shows a sectional view taken along a plane perpendicular to the axis of rotation of the heating roller.
Figure 5:
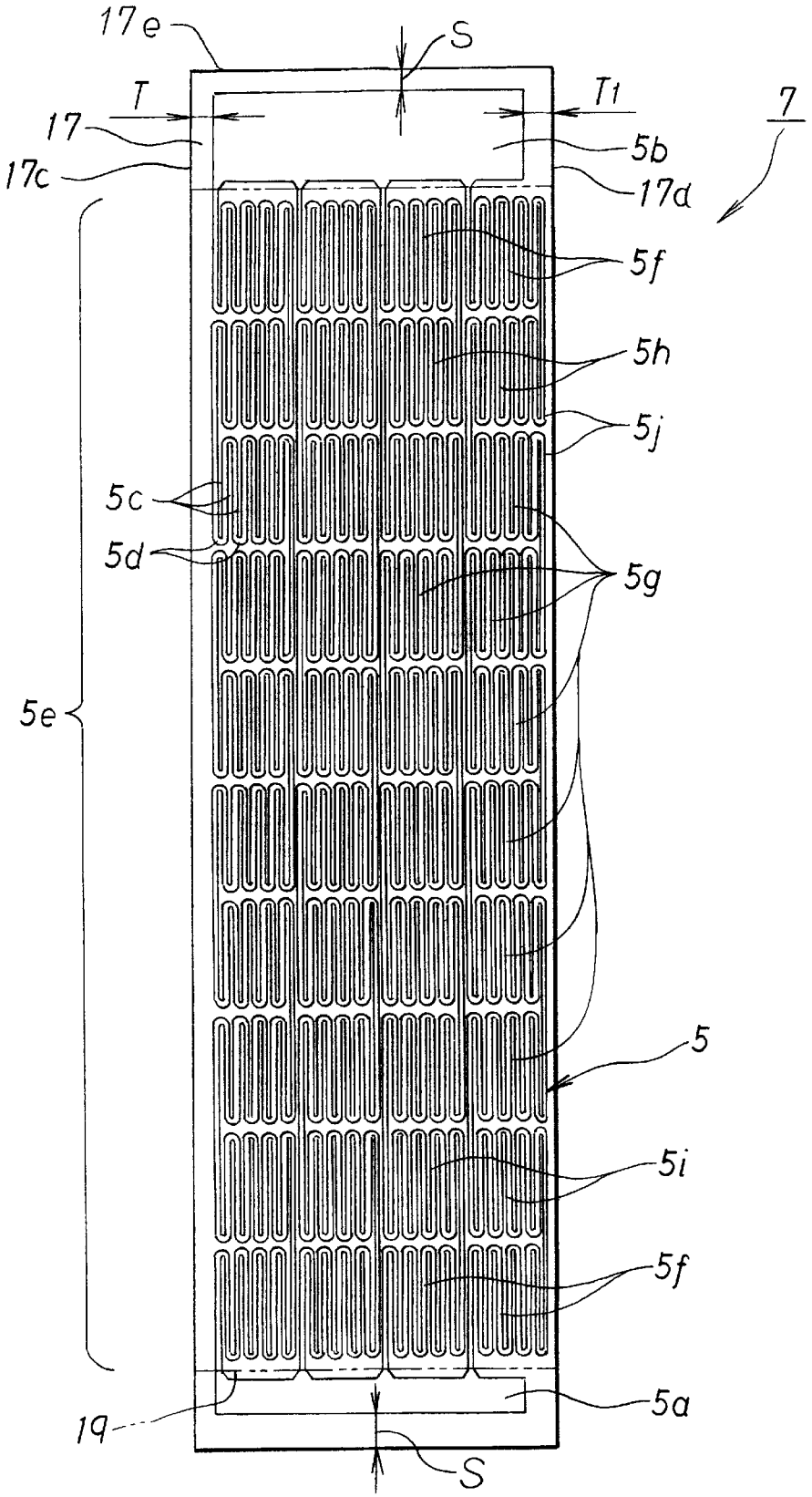
FIG. 5 shows a plan view illustrating a structure of a heat-generating element sheet of the heating roller.

Next, FIG. 4B shows a sectional view taken along a plane perpendicular to the axis of rotation of the heating roller 1. FIG. 5 shows a plan view illustrating the structure of the heat-generating element sheet 7. The heat-generating element sheet 7 includes an insulative film material 17 composed of two laminated films 17*a*, 17*b* (see FIG. 4) made of polyimide having insulation performance of 3 KV voltage resistance. A pattern 5 is formed by sticking a stainless steel (SUS) thin film to the surface of the insulative film material 17 followed by application of an etching treatment. As shown in FIG. 5, the insulative film material 17 is constructed to have a rectangular sheet-shaped configuration. The insulative film material 17 has its long side of a length which is the same as that of the main roller body 3, and its short side of a length which is longer than the length of the inner circumference of the main roller body 3 by a predetermined amount T (for example, 2.6 mm). Accordingly, when the insulative film material 17 is rounded in the short side direction (hereinafter referred to as "circumferential direction") to accommodate it into the inside of the main roller body 3, it can be arranged with an overlap of about T in the circumferential direction over the entire inner circumferential surface of the main roller body 3 as shown in FIG. 4B. Strictly speaking, the width of the overlap is slightly smaller than T taking the thickness of the insulative film material 17 into consideration.

The pattern 5 includes substantially rectangular power supply sections 5*a*, 5*b* (electrodes) at both ends in the long side direction (hereinafter referred to as "axial direction") of the insulative film material 17. Each of the power supply sections 5*a*, 5*b* is formed to have a band-shaped configuration ranging from a position separated by T from an end edge 17*c* which is arranged outside (on the inner circumferential side of the main roller body), to a position separated by T1 (T1 is slightly larger than T) from an end edge 17*d* which is arranged inside (on the side of the axis of rotation of the main roller body) when the insulative film material 17 is accommodated in the main roller body 3. Each of the power supply sections 5*a*, 5*b* is formed while leaving a spacing distance of a predetermined amount (for example, 2.6 mm) from an end edge 17*e* on both end sides in the axial direction of the insulative film material 17. As for the width of each of the power supply sections 5*a*, 5*b* (length in the axial direction), the width of the power supply section 5*b* on the side on which the spur gear 13 is arranged is formed to be wider than the width of the power supply section 5*a*. A large number of meandering patterns meander between the power supply sections 5*a*, 5*b*, comprising, in connection, a large number of band-shaped sections 5*c* extending in the axial direction, and folded sections 5*d* formed between adjacent ends of the respective band-shaped sections 5*c*. Thus, a heat-generating section 5*e*, which is formed as a pattern of the resistance heat-generating element, is provided between the power supply sections 5*a*, 5*b*.

The heat-generating section 5*e* has, as a whole, its length in the axial direction, the length being slightly longer than that of the pressure contact portion with respect to the pressing roller 53. The heat-generating section 5*e* is formed to have the length in the circumferential direction ranging from the position separated by the predetermined amount T from the end edge 17*c* of the insulative film material 17 to a position just near to the end edge 17*d*. Further, a film 19 for interposing the heat-generating section 5*e* between the film 19 and the insulative film material 17 is laminated on the surface of the heat-generating section 5*e*. The film 19 is made of polyimide, and it does not cover the power supply sections 5*a*, 5*b*.

The meandering pattern for constructing the heat-generating section 5*e* is divided into blocks of 4 arrays in the circumferential direction and 10 arrays in the axial direction. The thickness of the pattern differs in the respective portions. The meandering patterns 5*f* of 8 blocks, which are arranged at the both ends in the axial direction, are formed to be thinnest, and they have a heat generation amount which is 1.4 times as large as that of the meandering patterns 5*g* of 6 arrays×4 arrays disposed in the vicinity of the center. The next thinnest is the meandering pattern 5*h* disposed in the second array on the side of the power supply section 5*b*, and it has a heat generation amount which is 1.2 times as large as that of the meandering patterns 5*g*. The next thinnest is the meandering pattern 5*i* disposed in the second array on the side of the power supply section 5*a*, and it has a heat generation amount which is 1.1 times as large as that of the meandering patterns 5*g*. Further, each of the meandering patterns 5*g* to 5*i* is constructed such that the pattern 5*j*, which is included in the range of the predetermined amount T1, is formed to have a thickness similar to that of the meandering pattern 5*f*. The setting of the thickness as described above can be easily carried out merely by changing the pattern of the resist during the etching.

The heat-generating element sheet 7 thus constructed is used as follows. That is, when the heat-generating element sheet 7 is accommodated in the main roller body 3 as described above, the heat-generating section 5*e* is arranged over the entire portion opposed to the pressing roller 53 in the axial direction and over the substantially entire circumference of the main roller body 3 in the circumferential direction. The portion, at which the insulative film material 17 is doubly overlapped, is constructed as shown in FIG. 4B. That is, the pattern 5*j* described above is arranged on the inner surface of the end of the insulative film material 17 overlapped at the inside.

The heat-generating element sheet 7 is accommodated in the main roller body 3 with the pattern 5 disposed inside. Therefore, the insulated state between the pattern 5 and the main roller body 3 is ensured by the insulative film material 17 (as described in detail later on). The resistance value of the heat-generating section 5*e* is much larger than the resistance value of the power supply sections 5*a*, 5*b*. Therefore, when the electric power is applied between the power supply sections 5*a*, 5*b*, the heat-generating section 5*e* generates the heat. The heat-generating element sheet 7 is allowed to make contact under the pressure with the inner circumferential surface of the main roller body 3 by the aid of the sponge tube 9. Further, the main roller body 3 has good thermal conductivity as well. Therefore, the heat, which is generated by the heat-generating section 5*e*, is transmitted uniformly and appropriately to the paper sheet interposed between the main roller body 3 and the pressing roller 53. Accordingly, the heating roller 1 is constructed as follows in order to apply the alternating current between the power supply sections 5*a*, 5*b*.

With reference to FIGS. 3, 4A, and 4B again, a pair of electrode holders 21, each of which is composed of an insulative material, are fitted to the both ends of the main roller body 3. The electrode holder 21 has a brim section 21a for engaging with the end edge of the main roller body 3 to avoid embedding. The brim section 21*a* is fitted to the inside of the insulative film material 17 to avoid rotation and spontaneous disengagement with respect to the main roller body 3. Usually, the insulative film material 17 is merely rounded and inserted into the main roller body 3 in order that the production steps are simplified and the invasion of air or the like is avoided. However, the insulative film material 17 may be glued to the inner circumferential surface of the main roller body 3. The electrode holder 21 supports an electrode plate 23 made of phosphor bronze in the diametric direction of the main roller body 3. Both ends 23*a* of the electrode plate 23 are bent in the inner direction of the main roller body 3 respectively. Each of tips 23*b* (see FIG. 4A) of the both ends 23*a* of the electrode plate 23 is bent in the outer direction of the main roller body 3 in parallel to the inner circumferential surface thereof to make contact with the power supply section 5*a* (or 5*b*). The tips 23*b* of the respective electrode plates 23 make contact at positions of the power supply sections 5*a*, 5*b* displaced from each other by 180°.

The outer end surface of each of the electrode plates 23 is supported, for example, by a pawl 21*b* formed on the inner circumferential surface of the electrode holder 21. The vicinity of the center of the electrode plate 23 is exposed to the outside of the electrode holder 21. A columnar silver electrode 71 abuts against the vicinity of the center of each of them. Each of the silver electrodes 71 is fixed to the cover 63 by the aid of a support plate 73 formed by bending a band-shaped member made of phosphor bronze or the like to have a ]-shaped configuration. An AC power source 75 (primary voltage) is connected between the pair of support plates 73. A thermostat 77 intervenes between one of the support plates 73 and the AC power source 75 to prevent the heating roller 1 from abnormal heat generation.

That is, the temperature of the heating roller 1 is adjusted at a predetermined temperature by allowing an unillustrated thermistor to abut against the outer circumferential surface of the main roller body 3 so that the electric power application amount to the support plate 73 is controlled on the basis of a detection signal obtained thereby. However, for example, if any abnormality occurs in the control system, the temperature of the heating roller 1 is abnormally raised in some cases. Accordingly, the fixing apparatus 51 includes the thermostat 77 provided on the cover 63 to forcibly shut off the electric power application passage led from the AC power source 75 to one of the support plates 73 when the temperature of the heating roller 1 is abnormally raised. The cover 63 is made of, for example, a resin having sufficient heat resistance such as PET (polyethylene terephthalate).

In the heating roller 1 constructed as described above, as shown in FIG. 4A, the power supply section 5*a* of the pattern 5 is arranged while giving the spacing distance of the predetermined amount S from the end edge 17*e* of the insulative film material 17. The power supply section 5*b* is also arranged while giving the spacing distance of the predetermined amount S from the end edge 17*e* disposed on the opposite side. The heat-generating section 5*e* is arranged while giving the spacing distances larger than the predetermined amount S from the end edges 17*e* on the both sides. Further, the end edges 17*c*, 17*d* of the insulative film material 17 are doubly overlapped with each other when the insulative film material 17 is arranged in the main roller body 3. Among them, the end edge 17*c* is arranged on the side of the main roller body 3. The power supply sections 5*a*, 5*b* and the heat-generating section 5*e* are arranged while giving the spacing distance of the predetermined amount T from the end edge 17*c*.

Accordingly, when the predetermined amounts T, S are set to be not less than 2.6 mm, the pattern 5 is not subjected to any electric leak via the end edges 17*c*, 17*d*, 17*e* of the insulative film material 17, even if a voltage of a commercial power source of 240 V is applied as the primary voltage. That is, the insulation performance is sufficiently ensured between the pattern 5 and the main roller body 3. Further, the electrode holder 21 is composed of the insulative material, and the insulative film material 17 is also arranged at the outer circumference of the electrode holder 21. Accordingly, the insulation performance is also ensured between the main roller body 3 and the electrode plate 23. Therefore, the fixing apparatus 51 makes it possible to fix the image safely and stably while suppressing the occurrence of noise and the disturbance of the image which would be otherwise caused, for example, by the electric leak from the pattern 5. Further, it is possible to apply the primary voltage to the pattern 5 so that the temperature-raising speed is appropriately improved.

In the fixing apparatus 51, the insulated state can be ensured by means of the simple structure in which the distances from the pattern 5 of the heating roller 1 to the end edges 17*c*, 17*d*, 17*e* of the insulative film material 17 are merely set as described above. Accordingly, it is possible to simplify the arrangement of the apparatus, and it is possible to appropriately reduce the production cost thereof. Further, the heating roller 1 includes the insulative film material 17 and the pattern 5 which are arranged along the inner circumferential surface of the main roller body 3. However, in general, when such an arrangement is adopted, it is extremely difficult to ensure the insulated state, for example, if the components are covered or coated with a resin. On the contrary, the heating roller 1 makes it possible to ensure the insulated state by means of the simple arrangement as described above. Therefore, the effect concerning the simplification of the arrangement appears more remarkably. Further, when the primary voltage is applied to the pattern 5 as described above, then the arrangement concerning the electric power application can be more simplified, and it is possible to further reduce the production cost.

As described above, the heating roller 1 includes the pattern 5 which is arranged on the side of the inner circumferential surface of the main roller body 3. Accordingly, there is no occurrence of abrasion and breakage of the pattern 5, making it possible to obtain extremely excellent durability. Further, the heating roller 1 uses the sponge tube 9 to allow the heat-generating element sheet 7 to make contact with the inner circumferential surface of the main roller body 3 under the pressure. Therefore, it is possible to heat the outer circumferential surface of the heating roller 1 more uniformly and more efficiently.

Therefore, the printer P, which is provided with the fixing apparatus 51, makes it possible to appropriately improve the thermal efficiency and the temperature-raising speed of the heating roller 1 so that the time required for the warming-up may be shortened. Further, the toner, which is deposited on the paper sheet, is uniformly heated to avoid any unevenness of the image during the fixing. Thus, it is possible to ensure the stable quality for printed matters or the like.

The spacing distance may be widened between the heat-generating section 5*e* and the main roller body 3, and the thermal efficiency may be lowered at the portion at which the insulative film material 17 is doubly overlapped. The thermal efficiency may be also lowered in the vicinity of the both ends of the heating roller 1 because of the large heat release amount. Especially, the heat release amount may be large at the end on the side at which the spur gear 13 is arranged. Accordingly, the heating roller 1 compensates the difference in thermal efficiency by means of the difference in heat generation amount concerning the meandering pattern 5*g* and the meandering patterns 5*f*, 5*h*, 5*i*, 5*j*. Further, the heat, which is generated by the heat-generating element sheet 7, is transmitted to the paper sheet and the toner via the main roller body 3. Accordingly, it is possible to obtain the more uniform temperature distribution on the surface of the heating roller 1. Therefore, the heating roller 1 makes it possible to appropriately suppress the occurrence of unevenness in temperature on the outer circumferential surface of the heating roller 1 both in the circumferential direction and in the axial direction. The toner, which is deposited on the paper sheet, can be uniformly fixed.

Further, the heating roller 1 comprises the band-shaped power supply sections 5*a*, 5*b* which are disposed on the inner surface side of the insulative film material 17 except for the doubly overlapping both ends and which extend in the circumferential direction along the both ends of the main roller body 3. Accordingly, when the heat-generating element sheet 7 is installed to the main roller body 3, both of the inner circumferential surfaces of the power supply sections 5*a*, 5*b* have the shape extremely approximate to the cylindrical surface. The electric power is supplied to the fixing apparatus 51 by allowing the electrode plates 23 to make contact with the foregoing portions. Accordingly, it is possible to supply the electric power extremely stably by using the simple structure. Therefore, the fixing apparatus 51 and the printer P provided therewith make it possible to further simplify the arrangement and the production steps of the apparatus, further reduce the production cost, and further improve the reliability of the apparatus.

The present invention is not limited to the respective embodiments described above at all, which may be carried out in other various forms without deviating from the gist or essential characteristics of the present invention. For example, a variety of arrangements may be conceived other than the electrode plate 23 for the power supply member fixed on the main roller body 3, for supplying the electric power to the power supply sections 5*a*, 5*b*.

Figure 6:
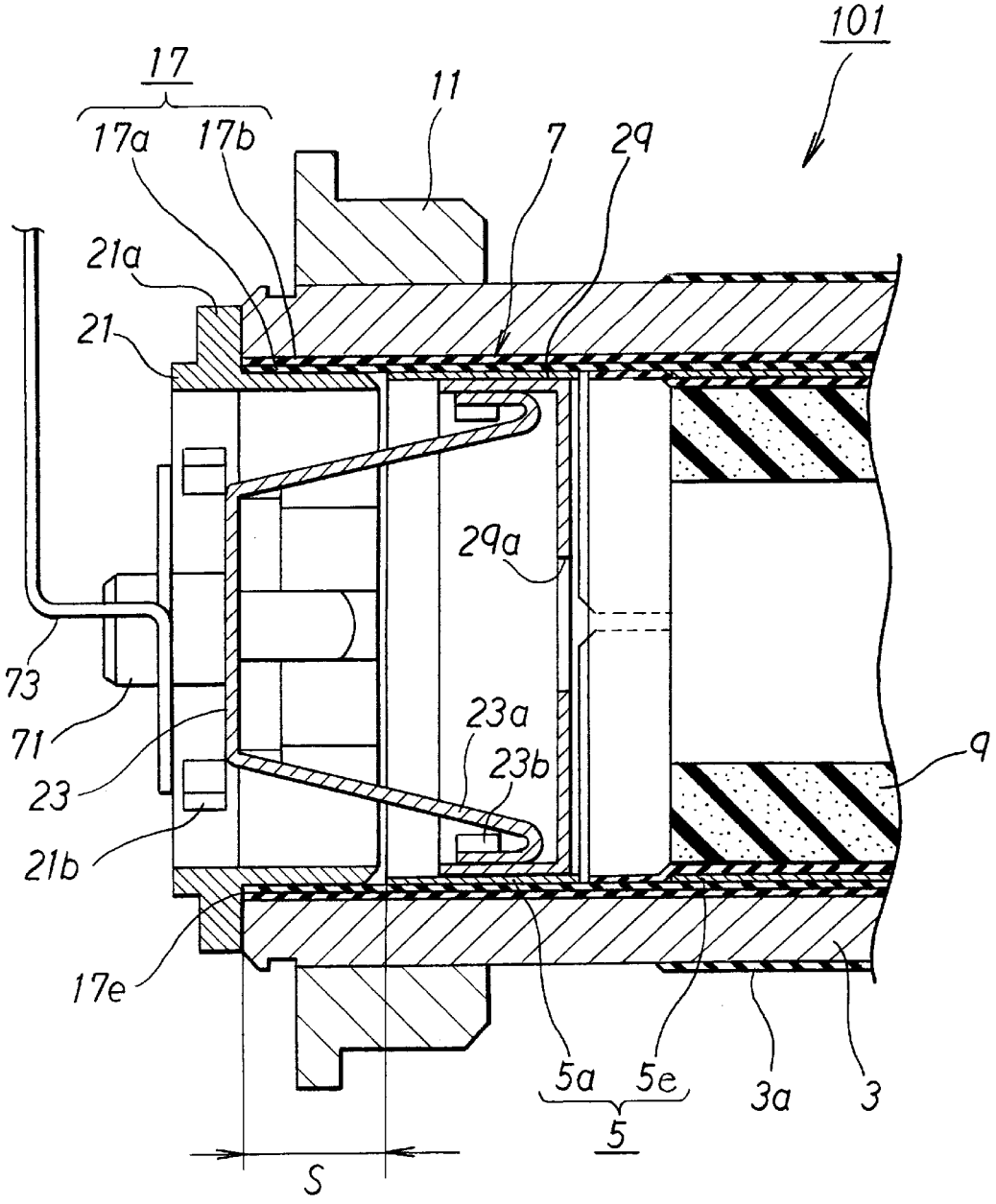
FIG. 6 shows a magnified sectional view illustrating a structure of a modified embodiment of the heating roller.

For example, as in a heating roller 101 shown in FIG. 6, a conductive ring 29 having a substantially annular configuration may be fitted to the inside of the power supply sections 5*a*, 5*b* (only the power supply section 5*a* is illustrated in FIG. 6), and the tip 23*b* of the electrode plate 23 may be allowed to make contact with the inner circumferential surface of the ring 29. In this embodiment, the electrode plate 23 and the ring 29 correspond to the power supply member. The electric power is supplied to the power supply sections 5*a*, 5*b* by the aid of both of them. In this embodiment, the contact between the ring 29 and the tip 23*b* is stabilized. Further, the power supply sections 5*a*, 5*b*, which are constructed to have the band-shaped configuration, make it possible to supply the electric power more stably. As shown in FIG. 6, the ring 29 has its open end surface disposed on the outer side in the axial direction. An air hole 29*a* for discharging the thermally expanded air is formed through the end surface disposed on the inner side in the axial direction.

Figure 7:
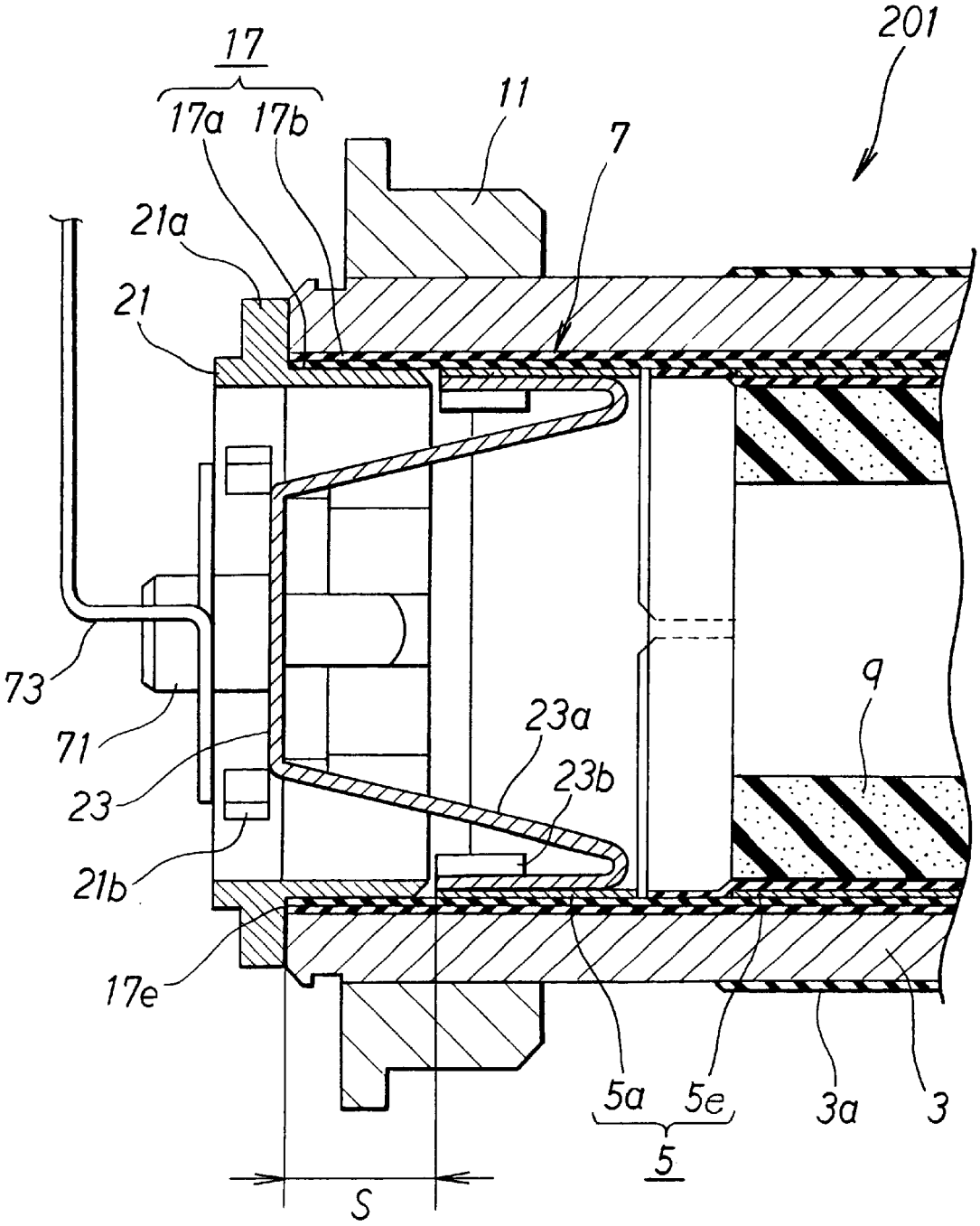
FIG. 7 shows a magnified sectional view illustrating a structure of another modified embodiment of the heating roller.

When the power supply members described above stick out from the pattern 5 toward the outside in the axial direction, it is also necessary to consider the insulation performance between the power supply members and the main roller body 3. For example, as in a heating roller 201 shown in FIG. 7, if the tip 23*b* of the electrode plate 23 sticks out from the power supply section 5*a* (and 5*b*) toward the outside, it is desirable that the spacing distance between the tip 23*b* and the end edge 17*e* of the insulative film material 17 is the predetermined amount S described above. By doing so, it is certainly possible to fix the image safely and stably while suppressing the occurrence of noise and the disturbance of the image as described above. The heating roller 201 is constructed in the same manner as the heating roller 1 described above except for the arrangement concerning the positional relationship between the power supply section 5*a* (and 5*b*) and the tip 23*b*.

Figure 8:
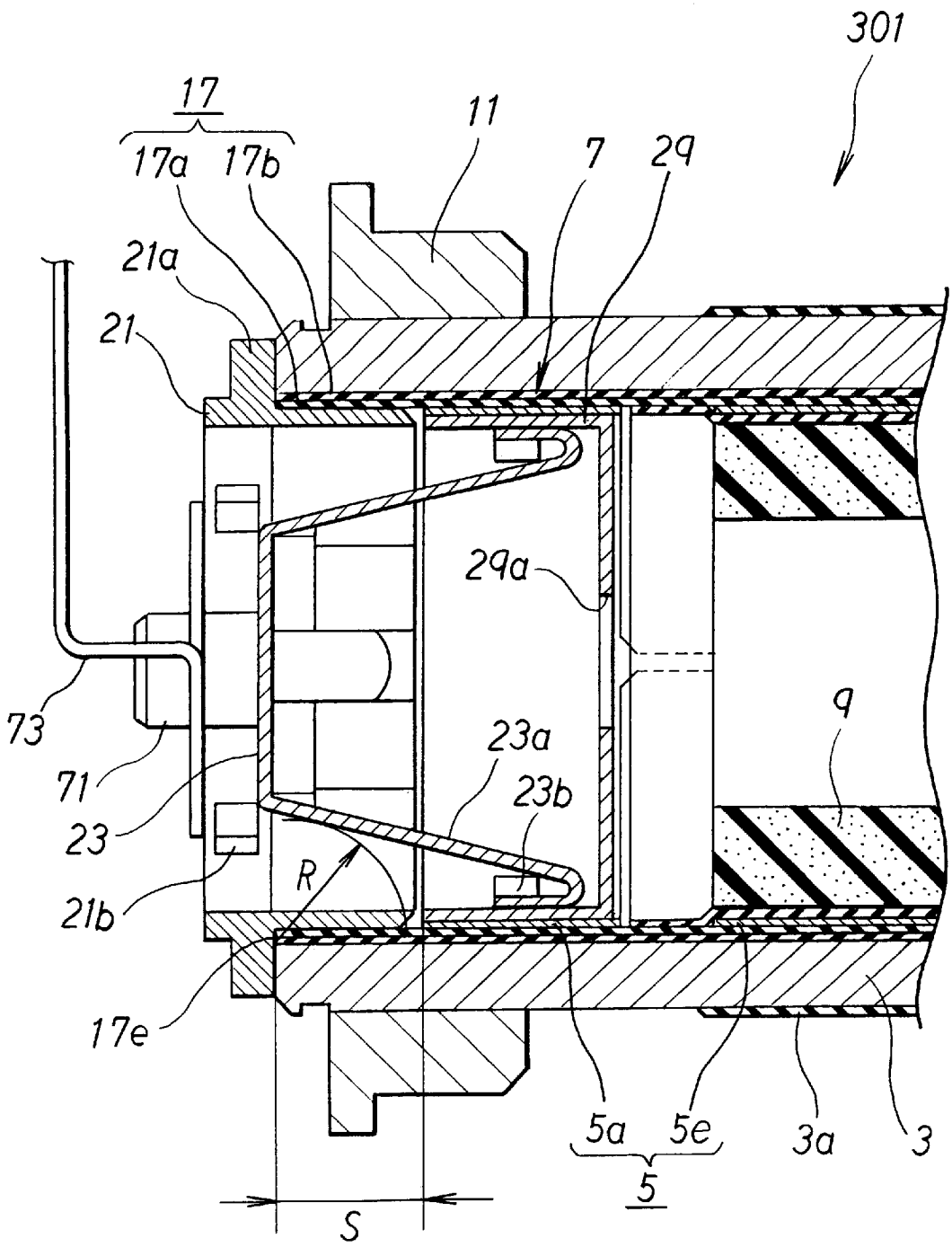
FIG. 8 shows a magnified sectional view illustrating a structure of still another modified embodiment of the heating roller.

Similarly, as in a heating roller 301 shown in FIG. 8, if the ring 29 sticks out from the power supply section 5*a* (and 5*b*) toward the outside, it is desirable that the spacing distance between the ring 29 and the end edge 17*e* of the insulative film material 17 is the predetermined amount S described above. By doing so, the sufficient insulation performance is ensured, it is possible to certainly avoid, for example, the electric leak, the short circuit, and the dielectric breakdown, and it is certainly possible to fix the image safely and stably. The heating roller 301 is constructed in the same manner as the heating roller 101 described above except for the arrangement concerning the positional relationship between the power supply section 5*a* (and 5*b*) and the ring 29.

If the electrode holder 21 does not have the sufficient insulation performance, as illustrated in FIG. 8, it is desirable that the shortest distance R from the end edge 17*e* to the electrode plate 23 is also set to be the distance capable of ensuring the insulation performance, for example, not less than 4 mm. The distance of 4 mm corresponds to the "minimum spatial distance required to be given between the primary circuit and the second circuit" as defined in Table 3 of the UL1950 standard. By doing so, it is possible to previously avoid the electric leak, the short circuit, and the dielectric breakdown, and it is certainly possible to fix the image safely and stably.

In the heating roller 1, each of the power supply sections 5*a*, 5*b* is constructed to have the band-shaped configuration disposed along the cylindrical surface. Accordingly, for example, a conductive brush, which is fixed on the side of the main printer body P (for example, the cover 63), may be allowed to make direct contact with each of the power supply sections 5*a*, 5*b*, without using the power supply members (for example, the electrode plate 23 and the ring 29) secured to the main roller body 3. However, when the electric power is supplied to the power supply sections 5*a*, 5*b* by the aid of the power supply members, then it is possible to further improve the degree of freedom of the design of the main printer body P, and it is possible to supply the electric power more stably. When the power supply member such as the ring 29 is used, it is not necessarily indispensable that the power supply sections 5*a*, 5*b* have the band-shaped configuration. On the contrary, when the power supply member is not used, then the entire structure of the printer P can be more simplified, and it is possible to reduce the production cost thereof more appropriately.

Figure 9:
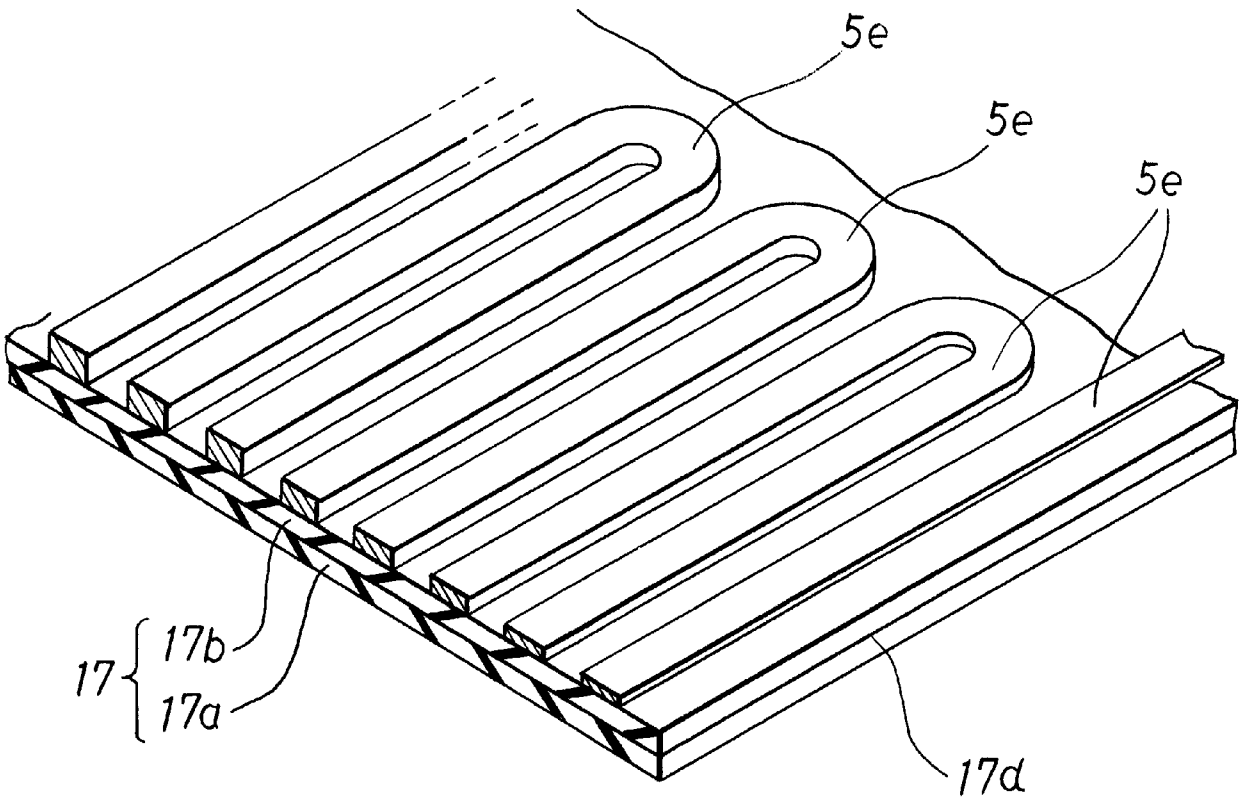
FIG. 9 shows a perspective view illustrating a structure of a modified embodiment of the heat-generating element sheet.

In the embodiment described above, the heat generation amount of the pattern 5*j* is increased as compared with the other portions by thinning the pattern 5*j* in the vicinity of the end edge 17*d*. However, the heat generation amount may be changed by using other various conceivable forms. For example, when the cross-sectional area of the pattern is decreased, the heat generation amount is increased in the same manner as in the embodiment described above. Therefore, as illustrated in FIG. 9, the thickness of the pattern for constructing the heat-generating section 5*e* may be made thin at portions nearer to the end edge 17*d*. However, as shown in FIG. 5, when only the width is narrowed while maintaining the constant thickness of the pattern 5, such a pattern 5 can be easily produced by means of a well-known etching process. Thus, it is possible to further simplify the production steps, and it is possible to further reduce the production cost.

On the contrary, as illustrated in FIG. 9, when the thickness of the pattern is made thin at the portion at which the insulative film material 17 is doubly overlapped, the amount of increase in thickness, which is caused by the overlap of the insulative film material 17, can be compensated by changing the thickness of the pattern. Therefore, the entire thickness of the heat-generating element sheet 7 arranged on the inner circumferential surface of the main roller body 3 is relatively uniform. In this embodiment, the pressurized contact force, which is exerted by the sponge tube 9, can be made uniform, and it is possible to suppress the occurrence of unevenness in temperature more appropriately. Consequently, it is possible to fix the toner deposited on the paper sheet more appropriately and uniformly. Accordingly, in this embodiment, it is possible for the printer P to ensure the more stable quality for printed matters of the like. Further, for example, a form is also conceived, in which the width of the pattern is narrowed and the thickness is thinned, as the form in which the cross-sectional area of the pattern for constructing the heat-generating section 5*e* is decreased in the vicinity of the end edge 17*d* as compared with the other portions.

Figure 10A:
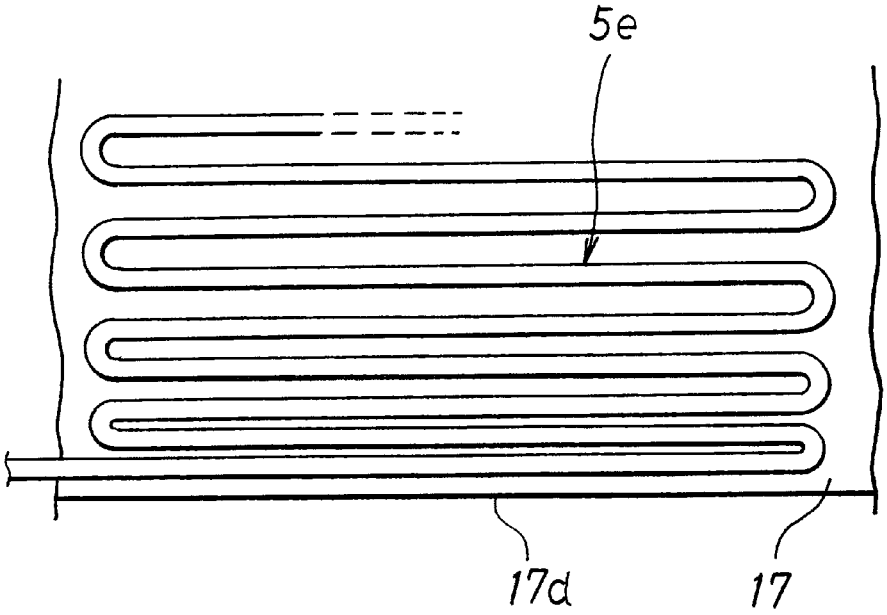
FIGS. 10A and 10B show explanatory views illustrating structures of other modified embodiments of the heat-generating element sheet.
Figure 10B:
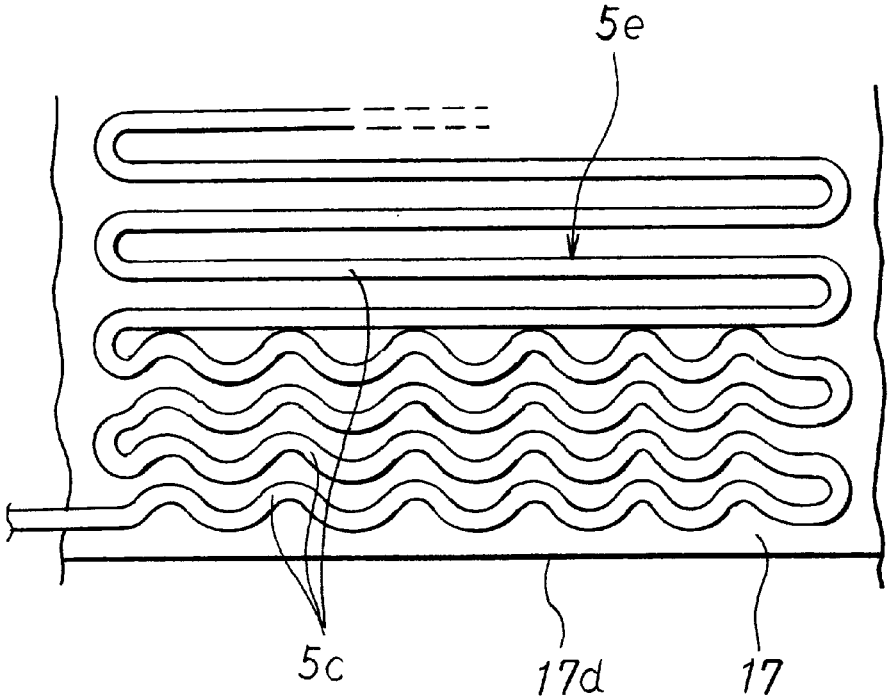

It is also conceived that the length per unit area of the pattern is made long with respect to the insulative film material 17, as the form in which the heat generation amount of the pattern for constructing the heat-generating section 5*e* is increased in the vicinity of the end edge 17*d*. Those conceived as the form of such a pattern include, for example, a form in which the pattern for constructing the heat-generating section 5*e* is densely folded in the vicinity of the end edge 17*d* as illustrated in FIG. 10A, and a form in which the band-shaped portion 5*c* of the pattern for constructing the heat-generating section 5*e* is also formed to have a meandering configuration in the vicinity of the end edge 17*d*. Such a pattern can be also produced easily by means of a well-known etching process, providing the same function and effect as those obtained in the embodiments described above. Further, the forms as described above may be combined with the arrangement in which the width and the thickness of the pattern are changed.

Further, for example, a form, in which the material quality of the resistance heat-generating element for constructing the pattern is locally altered, is also considered as the form in which the heat generation amount of the pattern for constructing the heat-generating section 5*e* is increased in the vicinity of the end edge 17*d*. However, in the respective embodiments described above, the heat generation amount of the pattern is partially changed by means of the simple arrangement in which the shape of the pattern is merely changed. Therefore, the structure and the production steps of the apparatus can be further simplified, and it is possible to further reduce the production cost.

It is also preferable that the heat-generating element sheet 7 is arranged along the outer circumferential surface of the main roller body 3. Also in this case, it is possible to obtain the same function and effect as those obtained in the embodiments described above. When the heat-generating element sheet 7 is arranged along the outer circumferential surface of the main roller body 3 as described above, the operation for arranging the heat-generating element sheet 7 is further easier as compared with the embodiments described above, while when such an arrangement is adopted, it is required to ensure the insulation and the abrasion resistance of the entire surface, because of the following reason. That is, it is intended to avoid any electric shock of the operator caused by any contact with the surface of the fixing heating roller 1, and avoid any damage exerted on the pattern 5 due to the abrasion.

The respective embodiments described above are illustrative of the case in which the predetermined amounts T, S are set to be 2.6 mm. However, the same effect is obtained when the predetermined amounts T, S are 1.4 mm if the voltage of the commercial power source as the primary voltage is 100 V. It is noted that the same effect is obtained when the predetermined amounts T, S are set to be not less than 2.6 mm, even if the printer P is used in every country in the world. The present T invention is not limited to the printer P described above, which is also applicable to a variety of image-forming apparatuses such as copying machines and facsimiles. The present invention is also applicable to those other than the image-forming apparatus based on the electrophotographic system. For example, the present invention is also applicable to an image-forming apparatus based on the hot melt ink-jet system in which an ink which is solid at ordinary temperature is melted to jet it so that an image is formed. In the embodiments described above, the insulative film material 17 is constructed by laminating the two films 17*a*, 17*b* made of polyimide. However, the film 17*b* made of polyimide may be omitted provided that the film 17*a* made of polyimide has sufficient insulation performance.

What is claimed is:

1. A fixing apparatus comprising a fixing beating roller for heating a recording medium on which a recording material is deposited, and a pressing roller for transporting the recording medium while interposing the recording medium between the fixing heating roller and the pressing roller, the fixing heating roller including:

a hollow main roller body; and a sheet-shaped insulative film provided on and along an inner circumferential surface of the main roller body, the sheet-shaped insulative film having a pattern of a resistance heat-generating element formed on the insulative film and an electrode pattern connected to the pattern of the resistance heat-generating element, wherein:

a margin is provided between the electrode pattern and at least one of edges of the insulative film, and the margin has a size which is not less than a distance that conforms to the UL1950 standard with respect to a voltage supplied to the resistance heat-generating element, the insulative film is arranged on the inner circumferential surface of the main roller body so that the edges of the insulative film in a circumferential direction are overlapped with each other, and the pattern of the resistance heat-generating element is formed in an overlapped area at the inner edge disposed on a side of a center of rotation of the main roller body, of the overlapped edges of the insulative film, and the resistance heat-generating element, which is formed in the overlapped area, has an amount of heat generation larger than that of the resistance heat-generating element formed on the other portions of the pattern.

2. The fixing apparatus according to claim 1, wherein the margin is provided between the electrode pattern and at least one edge of the insulative film in a circumferential direction.

3. The fixing apparatus according to claim 1, wherein the margin to the electrode pattern from the outer edge disposed on an inner circumferential side of the main roller body, of the overlapped edges of the insulative film in the circumferential direction is not less than the distance which conforms to the UL1950 standard with respect to the voltage supplied to the resistance heat-generating element.

4. The fixing apparatus according to claim 3, wherein the margin from the outer edge to the pattern of the resistance heat-generating element is also not less than the distance which conforms to the UL1950 standard with respect to the voltage supplied to the resistance heat-generating element.

5. The fixing apparatus according to claim 4, wherein the margin is about 2.6 mm.

6. The fixing apparatus according to claim 1, wherein the margin is not less than 2.6 mm when a voltage of 240 V is applied to the resistance heat-generating element.

7. The fixing apparatus according to claim 1, further comprising a power supply member fixed to the main roller body to make contact with the electrode pattern for supplying electric power to the electrode pattern, wherein a distance from the power supply member to the edge of the insulative film is not less than the distance which conforms to the UL1950 standard with respect to the voltage supplied to the resistance heat-generating element.

8. The fixing apparatus according to claim 1, wherein the electrode pattern is a band-shaped pattern extending in a circumferential direction on the insulative film.

9. The fixing apparatus according to claim 1, wherein the resistance heat-generating element formed on the overlapped area at the inner edge has a cross-sectional area of the element which is smaller than a cross-sectional area of the resistance heat-generating element formed on the other portions of the pattern.

10. The fixing apparatus according to claim 1, wherein the resistance heat-generating element formed in the overlapped area at the inner edge has a length of the element per unit area of the insulative film, the length being shorter than a length per unit area of the insulative film, of the resistance heat-generating element formed on the other portions of the pattern.

11. The fixing apparatus according to claim 1, wherein the pattern of the resistance heat-generating element is not formed in an overlapped area at the outer edge disposed on an inner circumferential side of the main roller body, of the edge at which the insulative film is overlapped.

12. The fixing apparatus according to claim 1, wherein the insulative film is a rectangular sheet-shaped film, the insulative film is rounded and inserted into a hollow section of the main roller body, and thus the insulative film is provided to be disposed on and along the inner circumferential surface of the main roller body.

13. The fixing apparatus according to claim 1, wherein the electrode pattern is further provided with a margin of not less than the distance which conforms to the UL1950 standard with respect to the voltage supplied to the resistance heat-generating element, from the edge of the insulative film in a direction perpendicular to the circumferential direction.

14. An image-recording apparatus which includes the fixing apparatus as defined in claim 4.

15. An image-recording apparatus which includes the fixing apparatus as defined in claim 1.

16. A fixing apparatus comprising a fixing heating roller for heating a recording medium on which a recording material is deposited, and a pressing roller for transporting the recording medium while interposing the recording medium between the fixing heating roller and the pressing roller, a hollow main roller body;

a sheet-shaped insulative film provided on and along the inner circumferential surface of the main roller body, the sheet-shaped insulative film having a pattern of a resistance heat-generating element formed thereon; and a holder for holding the sheet-shaped insulative film on the inner circumferential surface of the main roller body, the holder being fitted to an inside of the sheet-shaped insulative film and having a brim for engaging with an edge of the main roller body.

17. The fixing apparatus according to claim 16, further comprising an electrode plate which contacts with a power supply section of the pattern of the resistance heat-generating element, the holder supporting the electrode plate.

18. The fixing apparatus according to claim 17, wherein the holder is composed of insulative material, whereby the insulative material of the holder and a portion of the insulative film to which the holder is fitted ensure an insulation between the main roller body and the electrode plate.

19. The fixing apparatus according to claim 17, wherein the holder includes a pair of electrode holders which are fitted into both openings of the hollow main roller body.

* * * * *